US005348063A

United States Patent [19]

Handleman

[11] Patent Number: 5,348,063

[45] Date of Patent: Sep. 20, 1994

[54] MATERIAL HANDLING SYSTEM

[75] Inventor: Avrom R. Handleman, Webster Groves, Mo.

[73] Assignee: Semi-Bulk Systems, Inc., St. Louis, Mo.

[21] Appl. No.: 144,806

[22] Filed: Oct. 29, 1993

Related U.S. Application Data

[63] Continuation of Ser. No. 402, Jan. 4, 1993, abandoned.

[51] Int. Cl.[5] ..... B65B 1/04; B65B 3/04

[52] U.S. Cl. ..... 141/314; 141/10; 141/68; 141/320; 141/263; 383/61

[58] Field of Search ..... 141/10, 67, 68, 313–317, 141/320–322, 325, 326, 353, 392, 114, 154, 263, 280, 281, 284, 387, 388; 220/256, 259; 383/61, 80, 96, 904; 137/587; 251/212

[56] References Cited

U.S. PATENT DOCUMENTS

| | | | |
|---|---|---|---|
| 43,706 | 8/1864 | Randall | 141/317 |
| 151,863 | 6/1874 | Downs | 141/317 |
| 2,296,163 | 9/1942 | Hartman | 226/48 |
| 2,525,113 | 10/1950 | Berg | 226/58 |
| 2,770,439 | 11/1956 | Stafford et al. | 249/60 |
| 3,334,779 | 8/1967 | Smith | 220/86 |
| 3,384,134 | 5/1968 | Hillerns | 141/314 |
| 3,478,922 | 11/1969 | Mole | 220/86 |
| 3,903,942 | 9/1975 | Vest | 141/301 |
| 4,056,132 | 11/1977 | Decrane | 141/285 |
| 4,109,836 | 8/1978 | Falarde | 222/494 |
| 4,182,386 | 1/1980 | Alack | 141/83 |
| 4,265,279 | 5/1981 | Weikert | 141/10 |
| 4,331,254 | 5/1982 | Haggerty | 220/229 |
| 4,493,475 | 1/1985 | Baird | 251/149 |
| 4,574,720 | 3/1986 | Lepisto | 141/10 |
| 4,760,933 | 8/1988 | Christner et al. | 220/86 |
| 4,872,493 | 10/1989 | Everman | 141/114 |
| 4,924,923 | 5/1990 | Boehmer et al. | 141/312 |
| 5,052,594 | 10/1991 | Sorby | 222/490 |
| 5,060,701 | 10/1991 | McCunn et al. | 141/21 |
| 5,095,959 | 3/1992 | Komassa et al. | 141/114 |

OTHER PUBLICATIONS

Article on Disc Valves by Mucon Products (2 pages). (No Date Available).

Article on Valve Range by Mucon Products (3 pages). (No Date Available).

Article on Uses of Mucon Valves as a Gland or Seal, 2 pages, Circa 1961.

Article on Mucon Flow Control Valves CH/16, Application Data Bulletin, 1 page, Circa 1965.

Article on Mucon Flow Control Valves CH/14, Application Data Bulletin, 1 page, Circa 1968.

Article on Mucon Flow Control Valves CH/8, Application Data Bulletin, 1 page, Circa 1972.

Article on Mucon Flow Control Valves CH/3, Application Data Bulletin, 1 page, 1993, but admitted prior art.

*Primary Examiner*—Henry J. Recla

*Assistant Examiner*—Steven O. Douglas

*Attorney, Agent, or Firm*—Senniger, Powers, Leavitt & Roedel

[57] ABSTRACT

A material handling system for effecting the transfer of powdered fluent material with respect to a container while preventing the escape of such material to a surrounding work environment. The system comprises a container having an opening in its top, a lower closure device secured to the container at its top movable between a closed position closing the container opening and an open position for permitting access to the interior of the container opening. An upper closure device is releasably attachable to the container above the lower closure device. At least part of the upper closure device is removed from the container to permit access to the container opening when the lower closure device is open. The system also includes a tubular head comprising an outer sleeve, and an inner tube mechanism inside the outer sleeve. The container is designed to be sealingly connected to the tubular head with the outer sleeve in sealing engagement with respect to the container when at least part of the upper closure device is removed from the container. The inner tube mechanism is movable axially relative to the outer sleeve between a raised position and a lowered position in which the inner tube means extends endwise down beyond the outer sleeve.

27 Claims, 11 Drawing Sheets

1
97
95
91
103
TO VACUUM
DUST COLLECTOR
175
181
175
115
133
93
171
25
171
173
45
173
9
3
83
13
7
11
P
81

TO VACUUM DUST COLLECTOR
153
161
163
157
141
143
47
61
25
27
173
173
3
9
13
139
7
11
137

MATERIAL HANDLING SYSTEM

This is a continuation, of application Ser. No. 08/000,402, filed Jan. 4, 1993, now abandoned.

SUMMARY OF THE INVENTION

This invention relates generally to material handling apparatus, and more particularly to a closed system for handling powdered or fine granular, fluent materials, the system enabling the fluent material to be readily loaded into and unloaded from a container without the discharge or escape of dust into the environment, and without exposing a person to the material being handled.

The present invention has particular (albeit not exclusive) application to a system of the type disclosed in co-assigned U.S. Pat. No. 4,182,386. That system includes a container having a rigid molded plastic pallet base and a flexible plastic film bag secured thereto. The bag has an open mouth defined by a substantially rigid collar which is adapted to be removably connected to and disconnected from a tubular delivery head used in the delivery of material to the bag to fill the bag. To unload the container, the collar is releasably connected to a tubular vent head and pressurized gas is introduced into the bag to condition the material therein for discharge from the container through a discharge port. Air introduced into the container percolates up through the material and vents through the vent head. After the unloading process is complete, the container is disconnected from the vent head.

While the system disclosed in the aforesaid patent prevents the escape of dust into the atmosphere during loading and unloading of the container, it does not eliminate the possibility that a person will be exposed to the material being handled while connecting the bag to the fill or vent head or while disconnecting the bag therefrom. In instances where the material being handled is toxic or otherwise constitutes a health hazard, it is important to eliminate all risk of such exposure, even during the connection and disconnection process.

Among the several objects and features of this invention may be noted the provision of a closed material handling system which reduces any risk of exposure to material being handled by the system, even during connection and disconnection of the container to the fill or vent head; the provision of such a system where connection and disconnection of the container from the fill or vent head can be accomplished quickly and easily; the provision of such a system which does not inhibit loading or unloading of the container; the provision of such a system which is economical to manufacture; the provision of an improved method of releasably connecting a container to a tubular fill or vent head prior to transfer of powdered fluent material to or from the container, the method being adapted to reduce exposure of a person to such material during connection of the container to the tubular head; and the provision of such a method which is further adapted to reduce exposure of a person to material during disconnection of the container from the head.

In general, a material handling system of this invention comprises a container defining a volume for containing a load of material and having an opening in the top of the container in communication with said volume, and a lower closure device secured to the container at the top thereof. The lower closure device is movable between a closed position closing the container opening and an open position for permitting access to said volume via the container opening. At least part of an upper closure device on the container above the lower closure device is adapted for removal from the container to permit access to the container opening when the lower closure device is in its open position. The system also includes a tubular head comprising an outer sleeve, and inner tube means inside the outer sleeve and generally coaxial therewith. The container is adapted to be sealingly connected to the tubular head with the outer sleeve in sealing engagement with respect to the container when at least part of the upper closure device is removed from the container. Actuator means is provided for moving the inner tube means axially relative to the outer sleeve between a raised position and a lowered position in which the inner tube means extends endwise down beyond the outer sleeve. The actuator means is operable to move the inner tube means from its raised position to its lowered position after the container has been connected to the tubular head with the outer sleeve in sealing engagement with respect to the container and with at least part of the upper closure device removed from the container, and, after the lower closure device has been opened, to permit passage of the inner tube means down through said container opening. The actuator means is further operable to move the inner tube means back to its raised position whereby said lower closure device may be closed prior to disconnection of the container from the tubular head.

This invention also involves a method of releasably connecting a container to a tubular head prior to transfer of a powdered fluent material with respect to the container. The method is adapted to reduce exposure of a person to such material during connection of the container to the tubular head. The tubular head comprises an outer sleeve and inner tube means inside the outer sleeve and generally coaxial therewith. The method comprises the following steps:

a) providing a container defining a volume for containing a load of the material and having an opening in the top thereof in communication with said volume, a lower closure device secured to the container at the top thereof movable between a closed position closing said opening and an open position for permitting access to said volume via said container opening, and an-upper closure device releasably attachable to the container above the lower closure device, at least part of the upper closure device being adapted for removal from the container to permit access to the container opening when said lower closure device is in its open position, b) releasably connecting the container to the tubular head with the outer sleeve in sealing engagement with respect to the container when at least part of the upper closure device is removed from the container and when said lower closure device is in its closed position, c) moving the lower closure device from its closed position to its open position, d) moving the inner tube means of the tubular head relative to the outer sleeve from a raised position to a lowered position in which the inner tube means extends down through said opening in the top of the container, and d) moving said lower closure device from its open position into sealing engagement with said inner tube means prior to transfer of material to or from the container.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
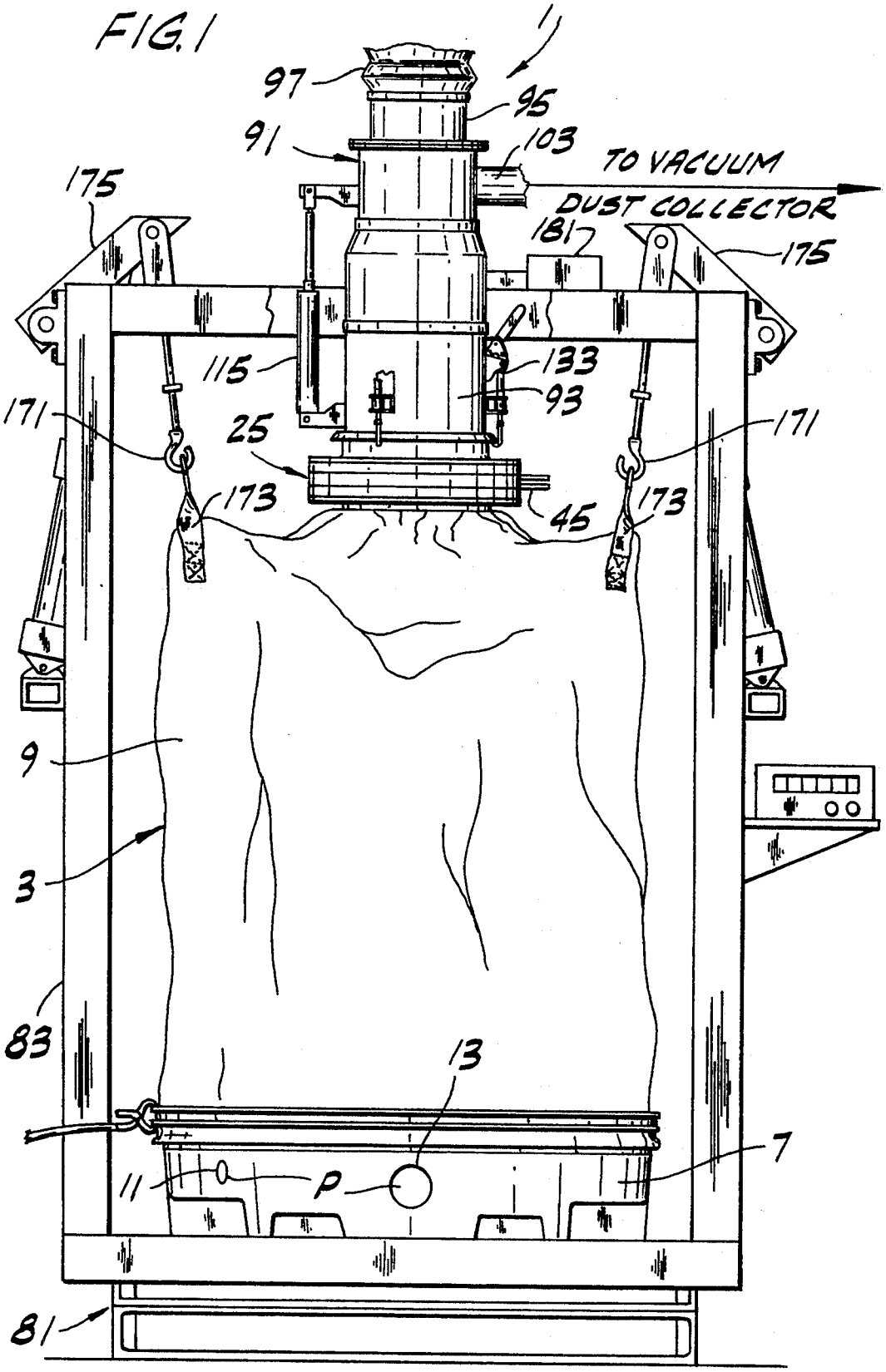
FIG. 1 is a front elevational view of a system of this invention showing a container in position on a scale for being filled with a load of powdered, granular or other fluent material by a filling apparatus incorporating a tubular fill head of this invention.

As noted, this invention relates to a material handling system for effecting the transfer of powdered or granular fluent material to or from a container while preventing the escape of such material to a surrounding work environment. As illustrated in FIG. 1, this system includes filling apparatus 1 and a container 3. The filling apparatus is adapted to fill the container with a load of powder, fine granular or other dry fluent material, and the container is adapted to sealably enclose a load of this material therewithin. As will appear, the system also includes unloading apparatus 5 for the unloading of material from the container (see FIG. 9).

The container 3 is similar in many respects to the above-discussed "Air Pallet" container described in detail in U.S. Pat. No. 4,182,386 and the related co-assigned patents discussed therein, all of which are hereby incorporated by reference. Thus, the container 3 includes a substantially rigid base 7 of suitable synthetic resin material, a flexible wall bag 9 sealingly secured to the base for defining a volume therewithin in which a load of powdered material may be loaded and contained, and a porous diaphragm (not shown) of cloth or other gas permeable material which overlies the deck of the base and defines a plenum chamber between the deck and the diaphragm for receiving compressed air or other gas introduced via an inlet 11 in the base. Upon introduction of pressurized gas (e.g., air) into the plenum chamber, it will be understood that gas will permeate through the diaphragm and condition the powdered load in the flexible bag thereabove to permit unloading of the material through a discharge opening 13 in the base.

Figure 2:
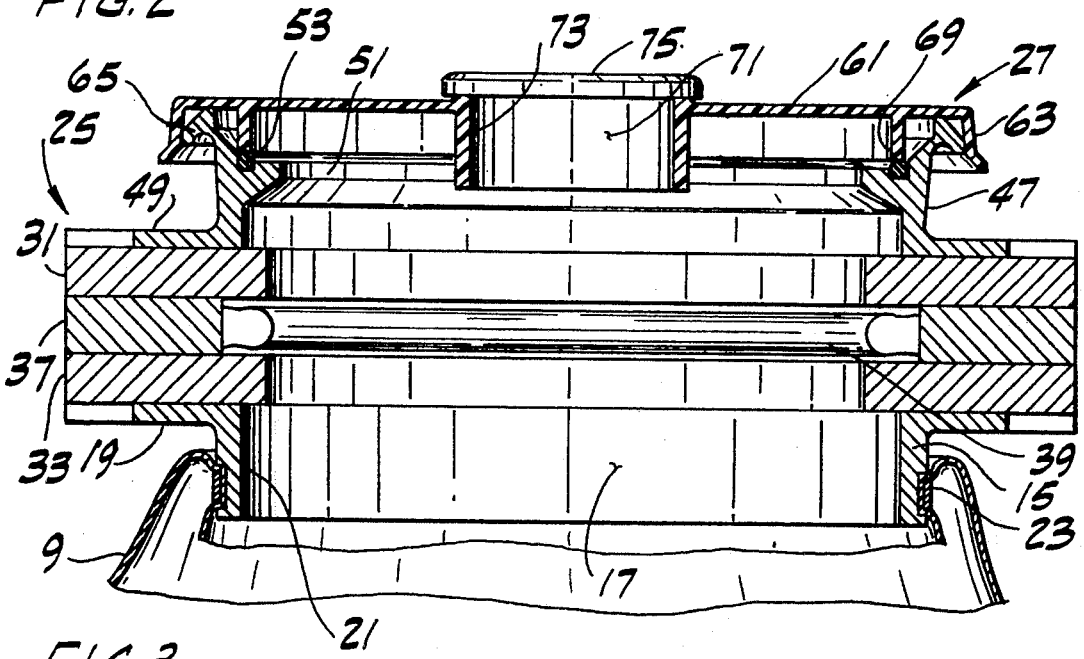
FIG. 2 is a cross-sectional view of an upper portion of the container showing a rigid collar secured to a flexible bag at its top, a lower closure device secured to the collar, and an upper closure device removably attachable with respect to the container, the lower closure device being shown in an open position for permitting access to the interior of the bag.
Figure 3:
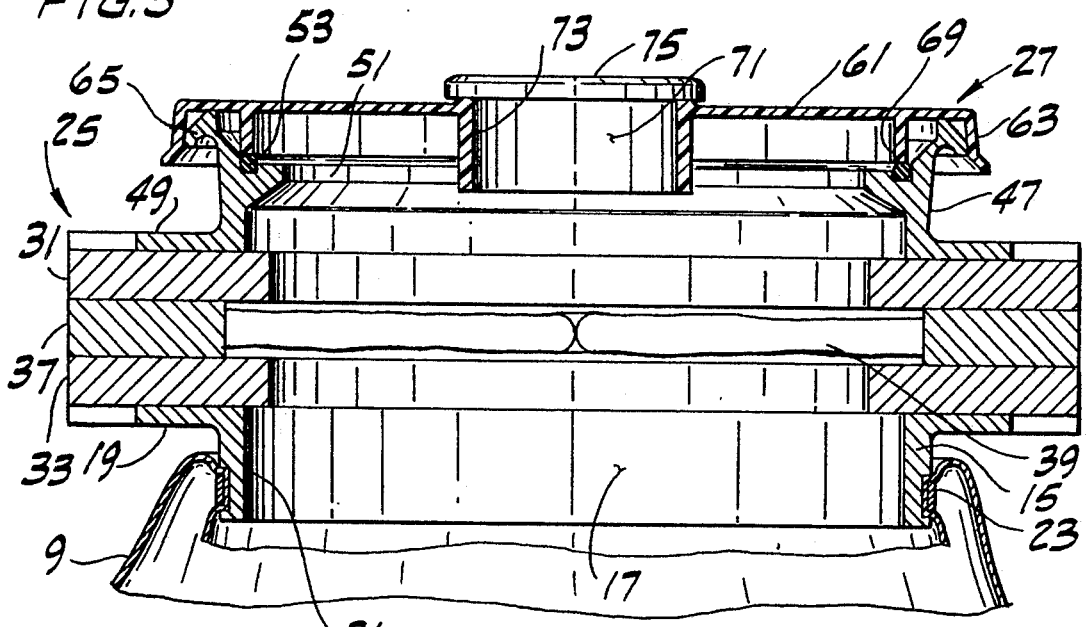
FIG. 3 is a view similar to FIG. 3 showing the lower closure device in a closed position.
Figure 4:
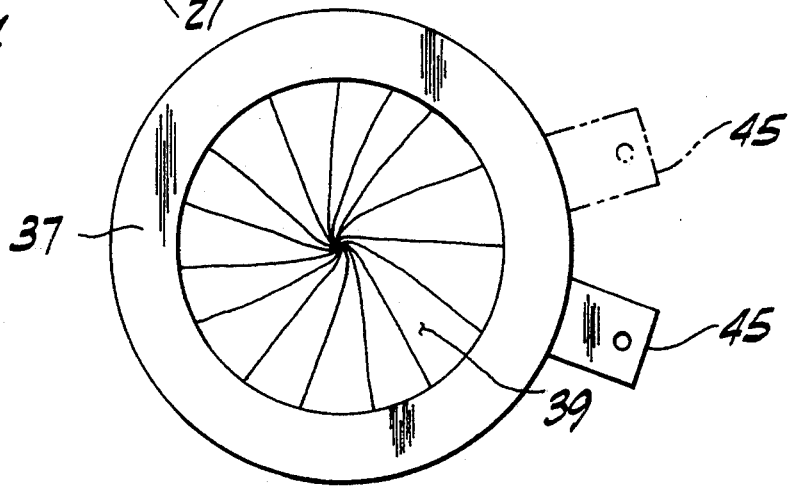
FIG. 4 is a top plan of the lower closure member showing a diaphragm of the closure device closed.

As best shown in FIGS. 2 and 3, the top of the bag is closed and it has a reclosable opening defined by a substantially rigid collar 15 having a central opening 17 therethrough with an outwardly projecting radial flange 19 at its upper end, and a sleeve 21 extending down from the flange. The bag is sealably secured to the sleeve 21 by a clamp ring 23. However, unlike the container described in U.S. Pat. No. 4,182,386, the container 3 of the present system also includes a lower closure device comprising an annular iris diaphragm valve generally designated 25 secured to the collar 15, and an upper closure device generally designated 27 on the container in a position above the valve. As will be described later in this specification, the iris valve 25 is operable in conjunction with the filling apparatus 1 and unloading apparatus 5 for substantially preventing the exposure of persons to materials being handled during the connect and disconnect sequences.

The iris valve 25 includes upper and lower substantially rigid rings indicated at 31 and 33, respectively, generally coaxial with the container opening 17, the lower ring being suitably fastened to radial flange 19 of the collar 15 defining the container opening. Alternatively, the lower ring 33 and collar 15 may be integrally formed as one piece. The valve 25 also includes an iris diaphragm assembly (shown in schematic form) 37 disposed between the upper and lower rings, including an iris diaphragm 39 and a valve actuator 45 for moving the diaphragm between an open position (FIG. 2) for permitting access to the interior of the bag via opening 17, and a closed position (FIG. 3) in which it closes the bag opening. As will be understood to those skilled in the art, the iris diaphragm is a tube of flexible material (e.g., rubber or fabric) fitted with a retaining ring at each end of the tube and, in the case of a double diaphragm valve, with a middle ring between the ends of the tube. Rotation of the end rings relative to one another (or, in the case of a double diaphragm valve, rotation of the middle ring relative to the end rings) causes the tube to flex and thereby progressively close the passage or aperture defined by the tube, similar to the iris of a camera.

Located above the iris valve 25 is an annular member 47 generally coaxial with the bag opening 17. Annular member 47 has a flange 49 which projects radially outward from its lower end and which is secured in suitable fashion (e.g., by fasteners) to the upper ring 31 of the iris valve. Alternatively, the annular member 47 could be formed as one piece with the iris valve. A circular shoulder 51 projects radially inward from the vertical wall of the annular member. This shoulder 51 has an upwardly facing surface with an annular groove formed therein for receiving an O-ring 53 seal, the function of which will become apparent.

The upper closure device 27 comprises a cover 61 removably attachable to the annular member 47. This cover is generally in the form of an inverted saucer having a depending outer flange 63 at its periphery adapted for releasable and sealing interengagement with a downwardly turned peripheral lip 65 at the upper end of the annular member 47. The cover also has a depending flange 69 spaced inwardly from the outer flange 63 adapted to fit down in the groove in the shoulder 51 of the annular member and to sealably engage O-ring seal 53 thereby to sealably cover the iris valve 25 and the container opening 17. Alternatively, the O-ring seal could be mounted on the cover 61 and be engageable with a projection on the annular member 47. As shown, the cover has a central opening or aperture 71 defined by a cylindric hub 73 projecting down from the top of the cover for receiving a removable plug 75.

The filling apparatus 1 is shown in FIG. 1 to be able to include an electronic platform scale, generally indicated at 81, and a frame 83 extending up from the platform and generally surrounding a container 3 on the platform. This scale and frame are described in U.S. Pat. No. 4,182,386 and reference may be made to this patent for further details regarding construction and operation.

Filling apparatus 1 further comprises a tubular delivery head generally indicated at 91 in FIG. 1 for the delivery of dry fluent material to the container to fill it, and for removing air from within the container displaced during filling of the container. As illustrated in FIGS. 5–8, the delivery head 91 comprises an outer sleeve 93 having a generally central vertical axis A, and inner tube means inside the outer sleeve comprising an inner fill tube 95 that communicates at its upper end with a material delivery conduit 97 and is concentric within an outer dust collection vent tube 99. The fill and vent tubes 95, 99 are coaxially disposed within the outer sleeve 93 and are spaced from one another to form an annular gap 101 therebetween which communicates with a source of vacuum through a dust collection conduit 103. The vent tube 99 has an outwardly projecting radial flange 105 at its upper end to which is sealingly secured an annular closure member 107. The inner fill tube 95 extends up through this closure member for connection to the delivery conduit 97, which is connected to a supply of powdered material (for example, an overhead hopper) and which has suitable valving associated therewith to control the supply of material to the fill tube 95. The closure member 107 is sealingly affixed, as by welding, to the fill tube 95 to provide a dust-tight seal therebetween. The fill and vent tubes are rigidly joined by the closure member 107 and are thus movable as a unit, as will appear.

Figure 5:
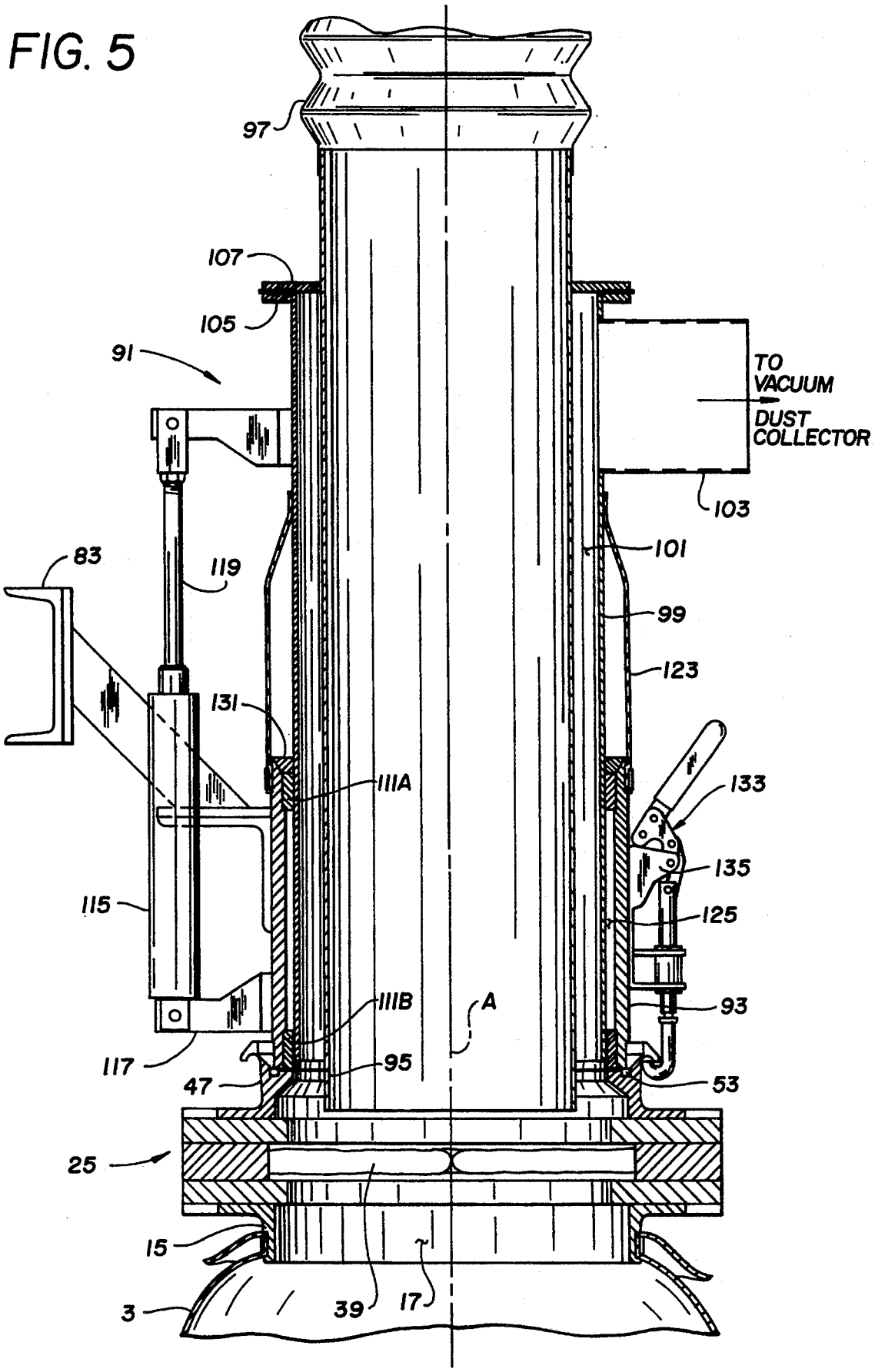
FIG. 5–8 are a series of vertical cross-sectional views depicting a method of this invention for sealably connecting the container to the tubular fill head in a way which reduces the risk of exposing a person to any material on the inside of the container.
Figure 6:
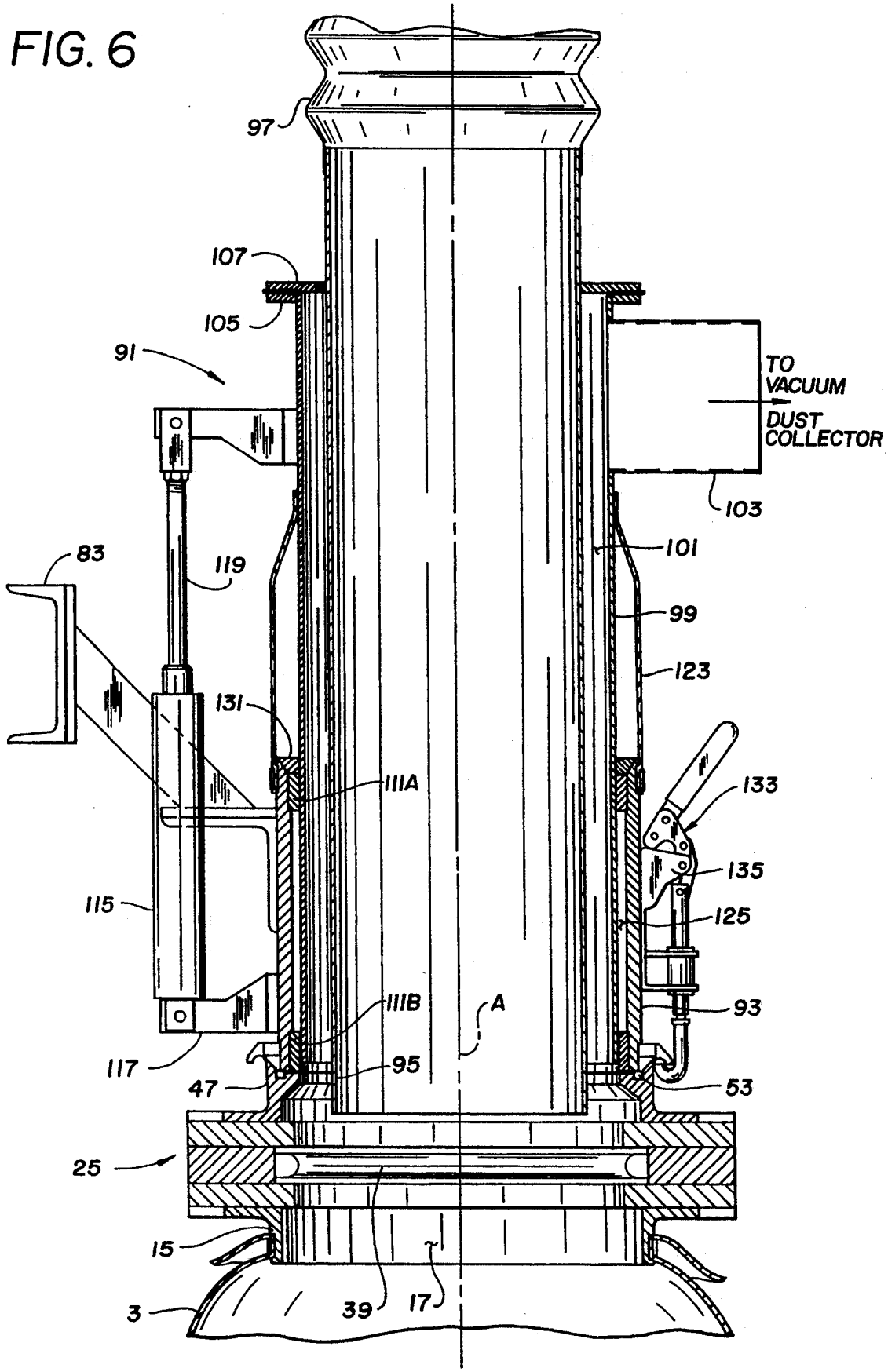

The outer sleeve 93 is suitably supported in appropriate position by the frame 83 of the filling apparatus 1. Guide means in the form of a pair of bushings 111A, 111B are mounted in annular recesses on the inside of the sleeve 93 adjacent its upper and lower ends for guiding the fill and vent tubes 95, 99 for conjoint movement up and down relative to the sleeve between a raised position (as shown in FIG. 5) and a lowered position (FIG. 7) in which the fill and vent tubes extend endwise down beyond the lower end of the outer sleeve. This movement is effected by suitable actuator means such as one or more cylinders 115 mounted on a support structure 117 affixed to the outside of the outer sleeve 93. The cylinder has a rod 119 connected at its upper end to the vent tube 99, the arrangement being such that retraction of the rod causes the fill and vent tubes to move downwardly as a unit relative to the outer sleeve, and extension of the rod causes the tubes to move upwardly relative to the sleeve. The delivery conduit 97 is sufficiently flexible to permit this reciprocal movement. A flexible sleeve 123 of dust impermeable material is sealingly attached at its lower end to the upper end of the outer sleeve 93 and at its upper end to the vent tube 99 to seal against the escape of dust (via the annular gap 125 between the vent tube and the outwardly spaced sleeve) into the surrounding environment during the filling process. A retaining ring 131 closes the upper end of the outer sleeve 93 and holds the upper guide bushing 111A captive in its annular recess.

The delivery head 91 further includes a plurality (e.g., three) of hand-operated toggle clamps, each generally designated 133, carried by brackets 135 mounted on the outside of the outer sleeve. These clamps constitute means for releasably and sealingly connecting a container to the delivery head, as will appear.

Figure 9:
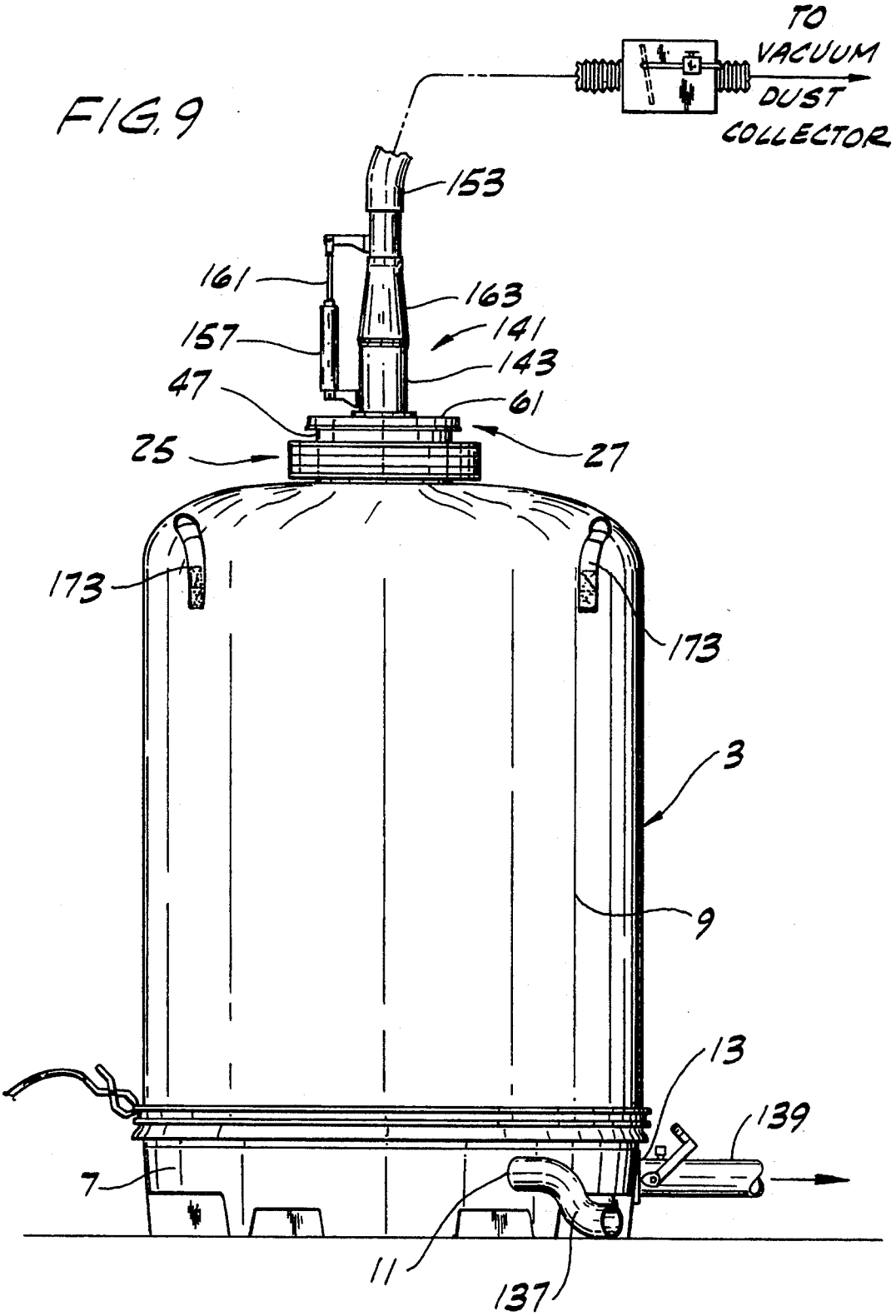
FIG. 9 is an elevational view of the container during fluidized unloading of the load utilizing a tubular vent head of this invention.

As previously mentioned, the system of this invention further involves unloading the load of dry fluent material from within the container in a relatively short time without releasing any substantial quantity of dust into the surrounding work environment. As best shown in FIG. 9, unloading of the container is accomplished by removing plugs P from outlet 13 and inlet 11 and by inserting a line or hose 137 in the inlet 11 of the base to introduce pressurized gas (e.g., air) into the plenum chamber to effect fluidization of the powdered material within the bag. An outlet conduit 139 is-sealably attached to outlet opening 13 in the base so that conditioned material may be carried away from the container.

Upon introduction of pressurized air or other gas into the plenum chamber so as to condition the powdered load in the bag, the air will percolate up through the load and inflate the bag. To allow for the escape of air from the bag, the unloading apparatus 5 of the present system includes a tubular vent head, generally designated 141 in FIG. 9.

As shown in FIGS. 10–13, the vent head 141 comprises an outer sleeve 143 having an outwardly projecting radial flange 145 at its lower end which carries an annular seal 147 which is sealingly engageable with the top surface of the cover 61 around the plug aperture 71 during the unloading process, as will appear. The vent head also includes inner tube means comprising a single vent tube 151 disposed inside the outer sleeve 143 and generally coaxially therewith. The vent tube 151 extends up through the open top of the outer sleeve 143 for connection to a flexible vent conduit 153 communicating with a dust collection system so as to substantially prevent the emission of dust into the atmosphere. A pair of guide bushings 155A, 155B are mounted on the inside of the outer sleeve adjacent its upper and lower ends for guiding the vent tube 151 for movement between raised (FIG. 10) and lowered (FIG. 12) positions, much like the fill and vent tubes of the delivery head 91 described above. A power actuator comprising, for example, a pneumatic or hydraulic cylinder 157, is carried by a support structure 159 affixed to outside of the outer sleeve 143. The rod 161 of the cylinder is connected at its upper end to the vent tube 151 to effect reciprocation of the tube between its raised and lowered positions. A flexible sleeve 163 sealingly secured to the vent tube and to the outer sleeve adjacent its upper end seals against the escape of dust via the annular gap 165 between the vent tube and the outer sleeve spaced radially outwardly therefrom.

In operation of the system of this invention, a container 3 is placed on platform 81 and positioned generally under the delivery head 91 of the filling apparatus 1. Hooks 171 are attached to loops 173 on the bag and air cylinders are operated to rotate lifting arms 175 upwardly to hold the bag substantially erect (see FIG.

1). The lower closure device 25 is then checked to make certain that the iris valve diaphragm 39 is closed, and the upper closure device or cover 27 is removed from the container. In the prior system described in U.S. Pat. No. 4,182,386, removal of the cover prior to connection of the container to the delivery head 91 presented a risk of exposing a person to any material remaining within the container from a previous load. However, with the system of the present invention, such risk is eliminated because the lower closure device 25 isolates the material from the person or persons operating the system.

After the cover 27 is removed, the annular member 47 at the top of the container is positioned under the outer sleeve 93 of the delivery head 91, and the hand-operated clamps 133 are operated so as to sealingly connect the delivery head to the container with the lower end of the outer sleeve in sealing engagement with the O-ring 53 on the annular member 47. During this procedure, the fill and vent tubes 95, 99 are in their stated raised position, as shown in FIG. 5. When the vent and fill tubes are raised, the lower end of the vent tube 99 is at approximately the same elevation as the lower end of the outer sleeve 93. The fill tube 95 preferably extends endwise down somewhat past the vent tube and outer sleeve, but only a relatively short distance so that it does not contact the closed diaphragm 39 of the iris valve 25.

Figure 7:
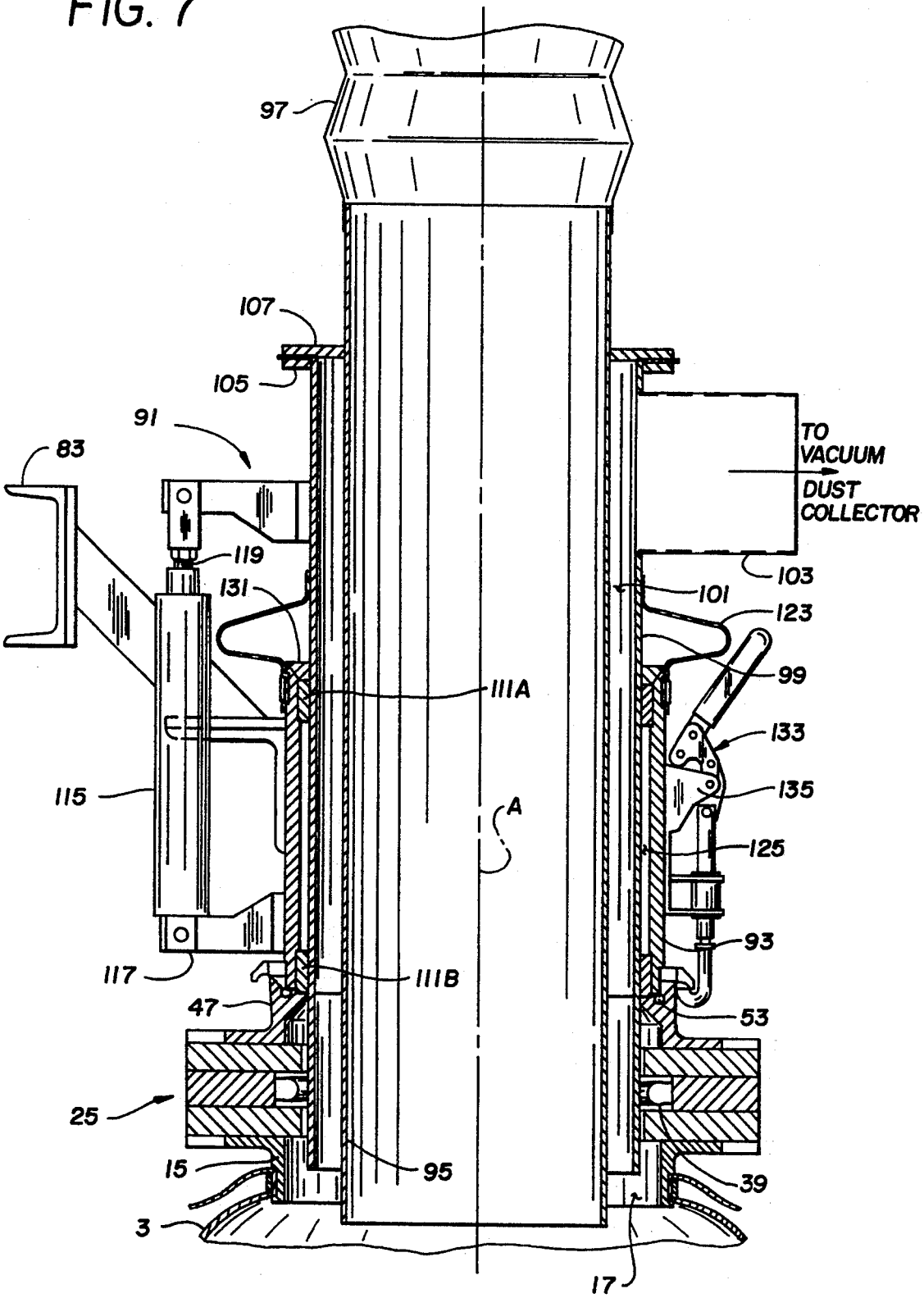
Figure 8:
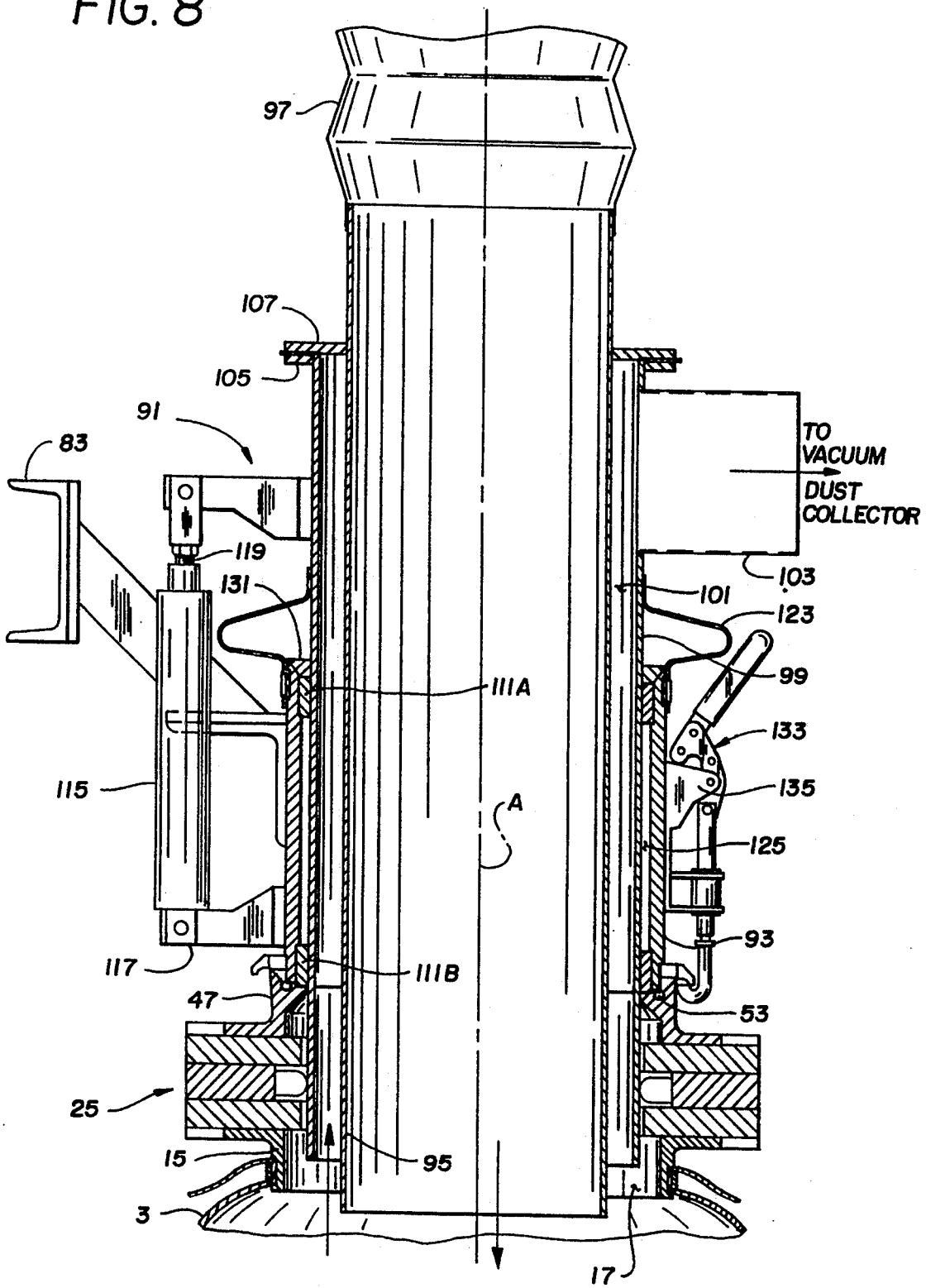

After sealably connecting the container to the delivery head, the iris valve 25 is opened (see FIG. 6), and the cylinder 115 is actuated to move the fill and vent tubes 95, 99 to their stated lowered position in which they extend down past the iris diaphragm 38 and into the opening 17 of the container defined by collar 15 (FIG. 7). The iris valve is then moved back toward its closed position until the diaphragm 38 is in sealing engagement with the vent tube (FIG. 8) around the entire circumference of the tube. Material is then delivered through the fill tube 95 to the container to fill it. As product enters the container, air from within the bag is drawn off to a vacuum dust collector via the vent tube 99. Dust is prevented from escaping into the area above the iris diaphragm 39 because of the seal between the diaphragm and the vent tube. After filling is complete, a vibrator (schematically indicated at 181 in FIG. 1) is energized to shake loose any powder that may cling to the interior of the fill tube 95. The operator then actuates the power cylinder 115 to move the fill and vent tubes to their raised position. The vacuum may continue to be drawn so as to "sweep" any dust particles that may cling to the iris valve and annular member 47 above the diaphragm 39.

Once the fill and vent tubes 95, 99 are raised, the iris valve 25 is closed to isolate the material in the container prior to disconnection of the container from the delivery head. This ensures that when such disconnection is made, there is no risk of exposure to material within the container. Disconnection is effected simply by releasing the clamps 133. The cover 61 is then resecured to the annular member 47.

Figure 10:
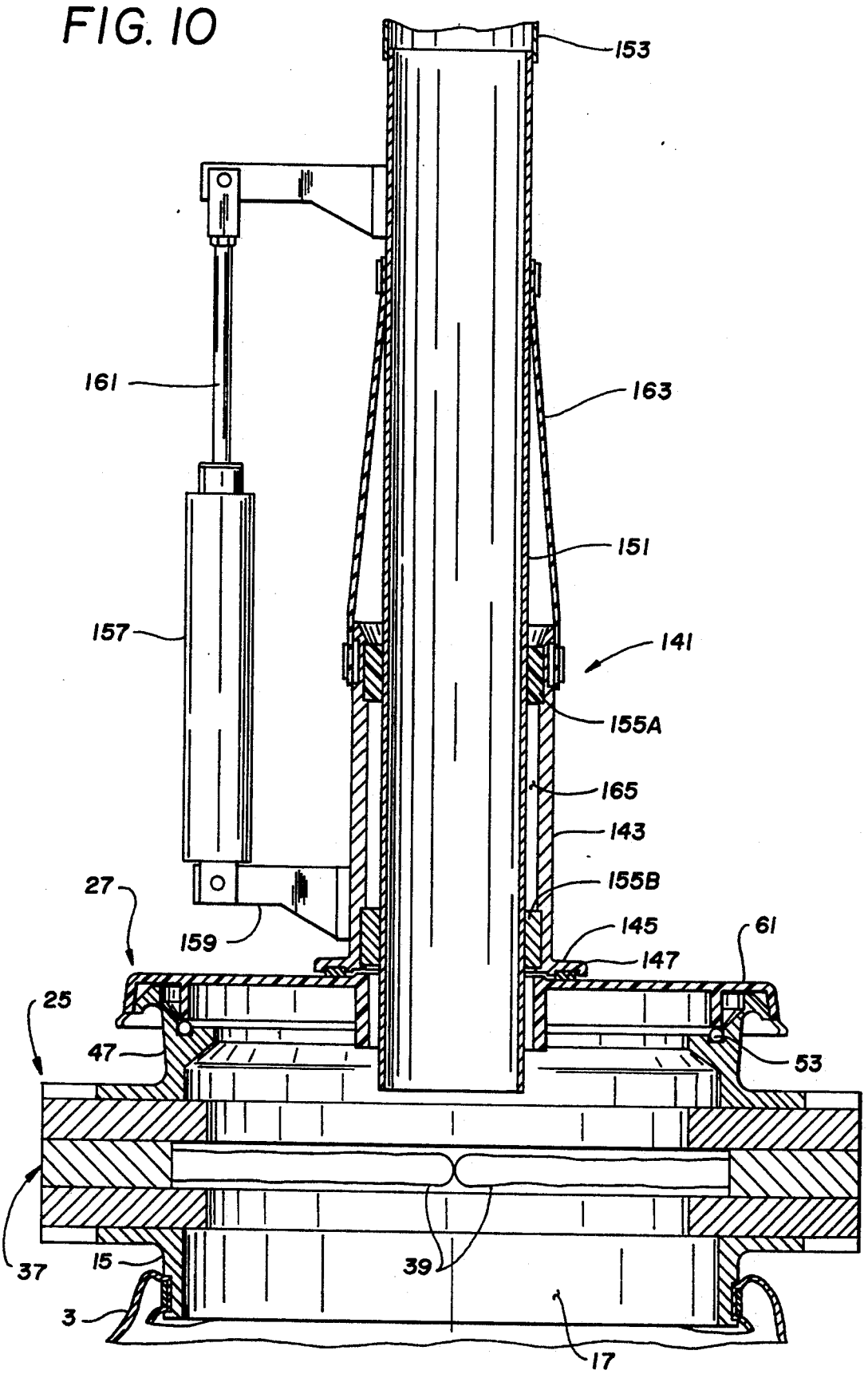
FIGS. 10–13 are series of vertical cross-sectional views depicting the method of this invention for sealably connecting the container to the vent head in a way which reduces the risk of exposing a person to material in the container.
Figure 11:
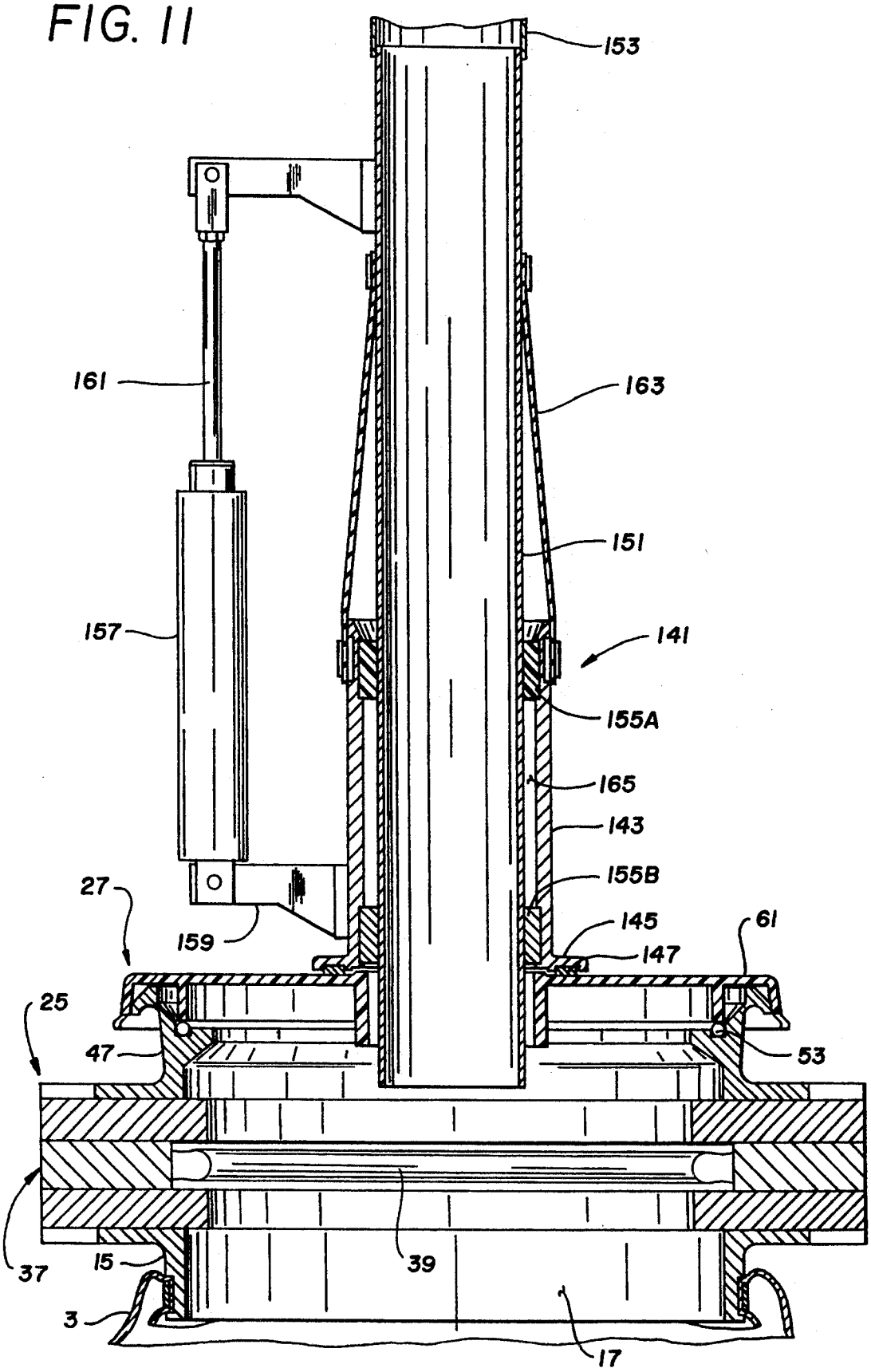

When it is desired to unload the powdered fluent material from within the container, the plugs P are removed from openings 11 and 13 in the base 7 of the container 3 and outlet conduit 139 is sealably inserted into the outlet opening 13. A pressurized gas line 137 is also sealably inserted in inlet 11. After making certain that the iris valve 25 is closed, the plug 75 is removed from the central aperture 71 in the cover 61 and the vent head 141 is connected to the container. This is accomplished by inserting the lower end of the vent tube 151 (which is in its raised position) down through the cover aperture 71 until the seal 147 at the lower end of the vent tube is brought into sealing engagement with the top surface of the cover 61 around the aperture 71, as shown in FIG. 10. As shown, when the vent tube is in its raised position, it preferably extends endwise down beyond the lower end of the outer sleeve 143, but only a relatively short distance so that it does not contact the closed diaphragm 39 of the iris valve 25.

Figure 12:
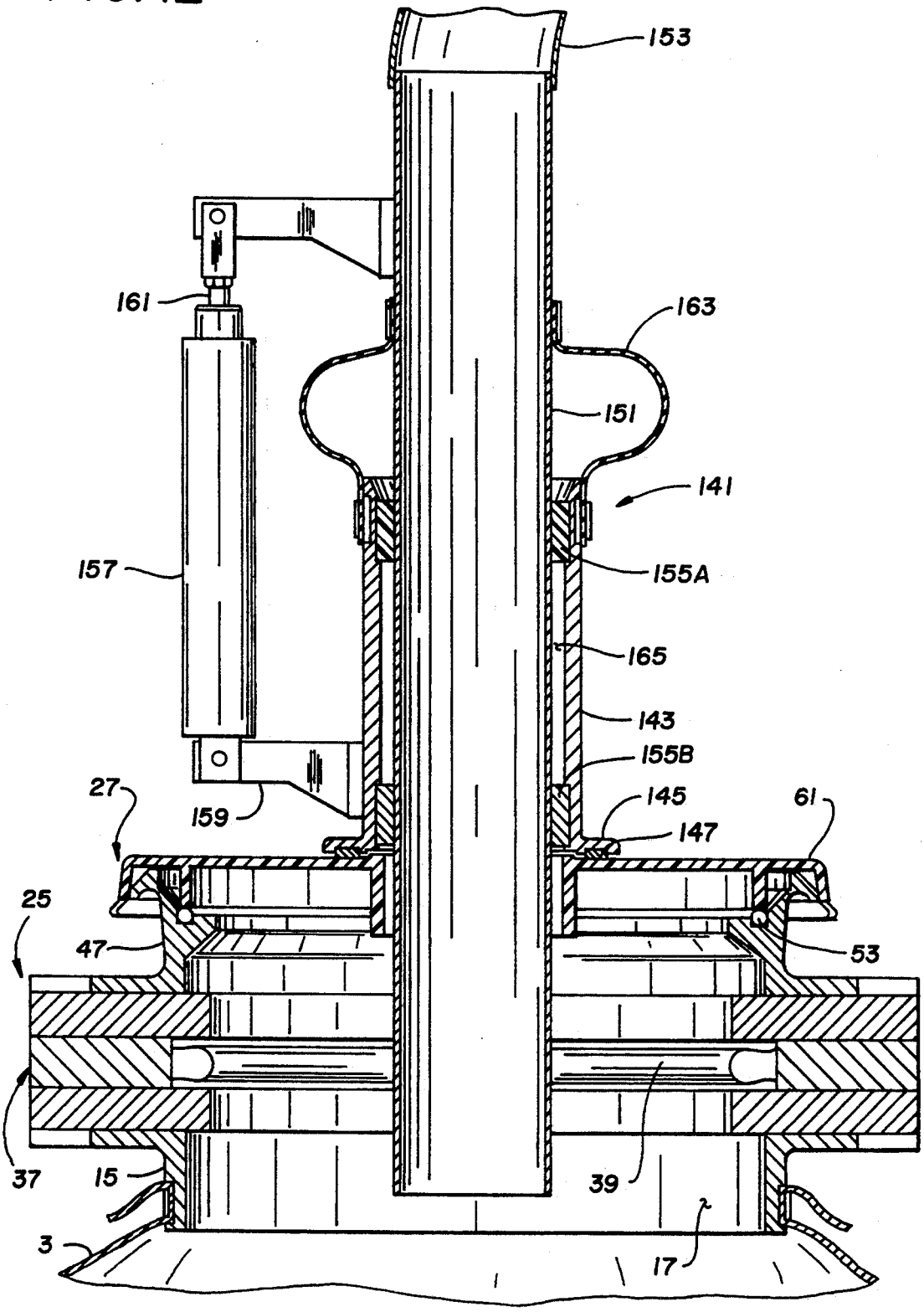
Figure 13:
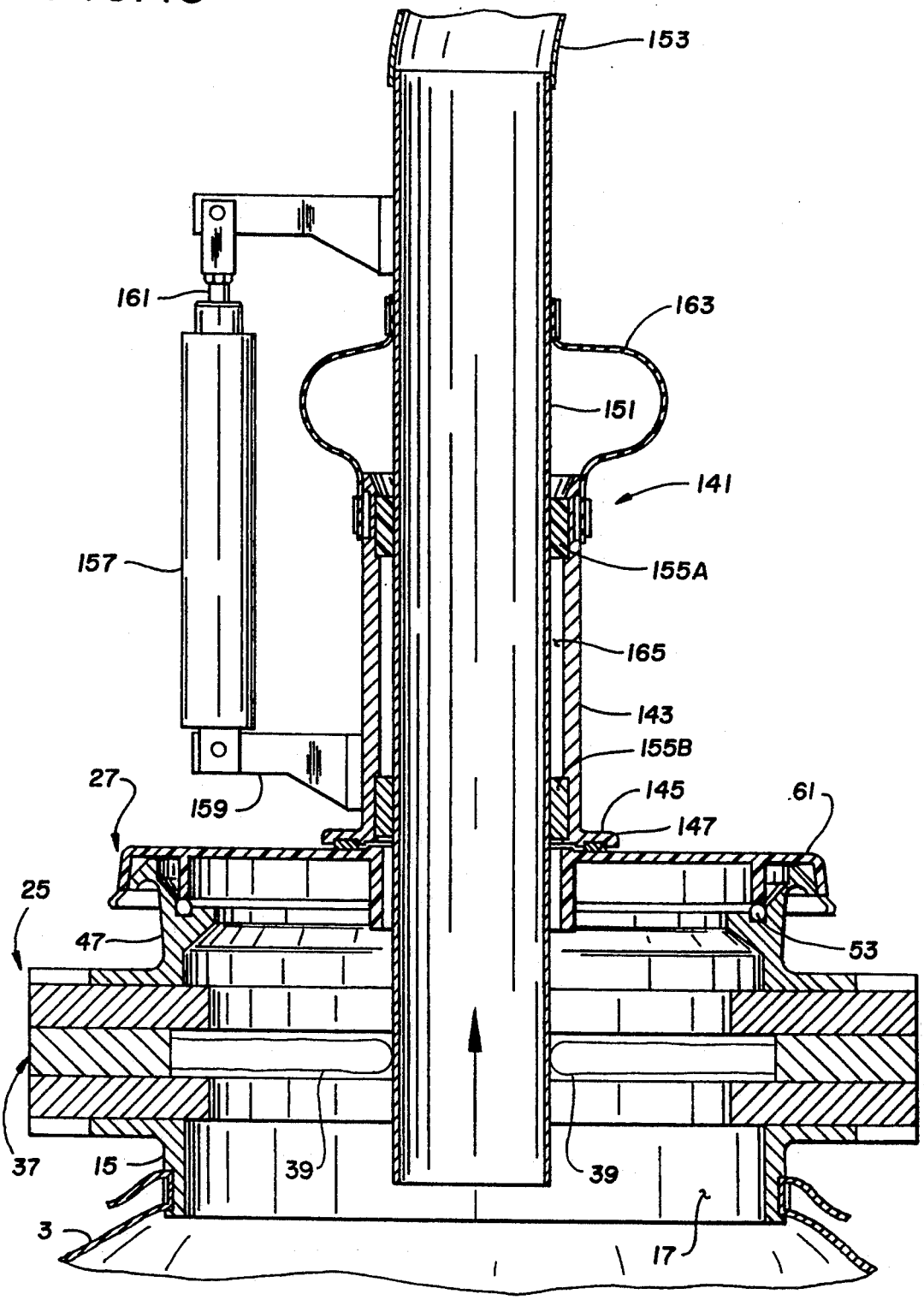

After the sealing connection between the outer sleeve 143 and the cover 61 is made, the iris valve 25 is opened (FIG. 11), and the cylinder 157 is actuated to move the vent tube 151 to its lowered position in which it extends down past the iris diaphragm 39 and into the opening 17 of the container defined by collar (FIG. 12). The iris valve 25 is then moved back toward its closed position until the diaphragm 39 is in sealing engagement with the vent tube around the entire circumference of the tube (FIG. 13). Thereafter material is unloaded from the container by introducing pressure air or other gas into the plenum chamber via inlet 11, the powdered load pressing down on the porous diaphragm thus being uniformly fluidized and readily discharged through the outlet 13. Excess air is vented through the vent tube 151 to a dust collector or the like.

After unloading is complete, the operator actuates the power cylinder 157 to move the vent tube 151 to its raised position. The iris diaphragm 39 is preferably (but not necessarily) moved to a fully open position and out of sealing engagement with the vent tube prior to raising the tube. A vacuum may continue to be drawn even after the vent tube is raised to "sweep" any dust particles that may cling to the valve and annular member 47 in the area above the diaphragm 39.

Once the vent tube 151 is raised, the iris valve 25 is closed to isolate the material in the container prior to disconnection of the container from the vent head 141. This ensures that when such disconnection is made, there is no risk of exposure to any material remaining within the container. The plug 75 is then reinserted in the central aperture 71 in the container.

It will be understood that the design of the upper and lower closure devices 25, 27 may vary without departing from the scope of the invention. For example, with respect to the lower closure device 25, an iris valve has been found to be particularly suitable because of its relatively thin profile and for its ability to seal against the vent tube 99 of the delivery head and the vent tube 151 of the vent head. An iris valve suitable for use in the present invention is of the type commercially available from Kemutec Group Ltd. of Macclesfield, Cheshire, United Kingdom, under the designation "Mucon". However, it will be understood that a lower closure device 25 of alternative design may also be suitable. It will also be understood that the upper closure device 27 may vary in design from cover 61. For example, while the system illustrated in the drawings involves removal of the entire cover 61 prior to connection of the delivery head 91 to the container, this need not be the case; the design could be varied so that only a portion of the cover (e.g., a plug similar to plug 75) need be removed. Similarly, the system could be designed so that the entire cover is removed prior to connection of the container to the vent head 141, rather than only part (e.g., plug 75) of the cover. In any case, it is essential that at least part of the cover be removed to permit access to the interior of the container.

In view of the above, it will be seen that the several objects of the invention are achieved and other advantageous results attained.

As various changes could be made in the above constructions and methods without departing from the scope of the invention, it is intended that all matter contained in the above description shall be interpreted as illustrative and not in a limiting sense.

What is claimed is:

1. A material handling system for effecting the transfer of powdered or granular fluent material with respect to a container while preventing the escape of such material to a surrounding work environment, said system comprising a container defining a volume for containing a load of said material and having an opening in the top of the container in communication with said volume, a lower closure device secured to the container at the top thereof, said closure device being movable between a closed position closing said opening and an open position for permitting access to said volume via said container opening, an upper closure device on the container above the lower closure device, at least part of said upper closure device being adapted for removal from the container to permit access to the container opening when said lower closure device is in its open position, a tubular head comprising an outer sleeve, and inner tube means inside the outer sleeve and generally coaxial therewith, the container being adapted to be sealingly connected to said tubular head with the outer sleeve in sealing engagement with respect to the container when at least part of said upper closure device is removed from the container, actuator means for moving said inner tube means axially relative to the outer sleeve between a raised position and a lowered position in which said inner tube means extends endwise down beyond the outer sleeve, said actuator means being operable to move said inner tube means from its raised position to its lowered position after said container has been connected to said tubular head with the outer sleeve in sealing engagement with respect to the container and with at least part of said upper closure device removed from the container, and after said lower closure device has been opened to permit passage of said inner tube means down through said container opening, and said actuator means being further operable to move said inner tube means back to its raised position whereby said lower closure device may be closed prior to disconnection of the container from the tubular head.

2. A system as set forth in claim 1 wherein said lower closure device is movable from its open position into sealing engagement around said inner tube means when the latter is in its lowered position.

3. A system as set forth in claim 1 further comprising an annular member secured to the container above the lower closure device, said upper closure device being removably mounted on said annular member.

4. A system as set forth in claim 3 further comprising a seal on said annular member sealingly engageable by said outer sleeve after said upper closure device has been removed from the container.

5. A system as set forth in claim 4 wherein said annular member has an upwardly facing annular surface with an annular groove therein, said seal comprising an O-ring seal in said groove sealingly engageable by said outer sleeve.

6. A system as set forth in claim 1 wherein said upper closure member comprises a cover removable from the container, said cover having an aperture therein, and a plug removably receivable in the aperture, said outer sleeve of the tubular head being adapted for sealing engagement with said cover around said aperture after said plug has been removed.

7. A system as set forth in claim 1 wherein said inner tube means comprises a fill tube through which material flows into the container to fill it, and a vent tube surrounding the fill tube and generally coaxial therewith, said vent tube being spaced from the fill tube to define an annular gap therebetween, said fill and vent tubes being movable conjointly between said raised and lowered positions.

8. A system as set forth in claim 7 wherein said lower closure device is movable from its open position to a position in which it is adapted to seal around the vent tube when the latter is in its lowered position.

9. A system as set forth in claim 8 further comprising a vacuum source communicating with said annular gap for drawing dust and dust laden air or other gas up through the gap during filling of the container.

10. A system as set forth in claim 1 wherein said inner tube means comprises a single vent tube through which gas is vented during unloading of the container.

11. A system as set forth in claim 10 wherein said lower closure device is movable from its open position to a partially closed position in which it is adapted to seal around said vent tube when the latter is in its lowered position.

12. A system as set forth in claim 1 wherein said lower closure device comprises an annular iris diaphragm valve.

13. A system as set forth in claim 12 wherein said iris diaphragm valve comprises upper and lower substantially rigid rings generally coaxial with said container opening, and an iris diaphragm disposed between the upper and lower rings.

14. A system as set forth in claim 13 further comprising an annular member attached to said upper ring, said upper closure device being removably mounted on said annular member, and a seal on said annular member engageable by the outer sleeve of the tubular head to provide a sealing connection therebetween.

15. A system as set forth in claim 1 wherein said container comprises a rigid base, a flexible bag secured to the base and defining said volume, an inlet for introduction of pressurized gas into said volume for conditioning said load, and an outlet for discharge of conditioned material from said volume.

16. A system as set forth in claim 1 further comprising guide means associated with said outer sleeve for guiding said inner tube means between its said raised and lowered positions.

17. A system as set forth in claim 1 further comprising means for releasably securing the container to said tubular head comprises clamping means carried by said outer sleeve and releasably engageable with said container for holding the outer sleeve in sealing engagement with respect to the container.

18. A system as set forth in claim 1 wherein said outer sleeve is spaced from said inner tube means to provide an annular gap therebetween, said system further comprising means for preventing the upward escape of dust via said annular gap.

19. A material handling system for effecting the transfer of powdered or granular fluent material with respect to a container while preventing the escape of such material to a surrounding work environment, said system comprising a container defining a volume for containing a load of said material and having an opening in the top of the container in communication with said volume, a lower closure device secured to the container at the top thereof, said closure device being movable between a closed position closing said opening and an open position for permitting access to said volume via said container opening, an upper closure device on the container above the lower closure device, at least part of said upper closure device being adapted for removal from the container to permit access to the container opening when said lower closure device is in its open position, a tubular head comprising an outer sleeve, and inner tube means inside the outer sleeve and generally coaxial therewith, the container being adapted to be sealingly connected to said tubular head with the outer sleeve in sealing engagement with respect to the container when at least part of said upper closure device is removed from the container, said inner tube means being movable axially relative to the outer sleeve between a raised position and a lowered position in which said inner tube means extends endwise down beyond the outer sleeve, said inner tube means being movable from its raised position to its lowered position after said container has been connected to said tubular head with the outer sleeve in sealing engagement with respect to the container and with at least part of said upper closure device removed from the container, and after said lower closure device has been opened to permit passage of said inner tube means down through said container opening, and said lower closure device being movable from its open position into sealing engagement around said inner tube means when said inner tube means is in its lowered position.

20. A method of releasably connecting a container to a tubular head prior to transfer of a powdered fluent material with respect to the container, said method being adapted to reduce exposure of a person to such material during connection of the container to the tubular head, said tubular head comprising an outer sleeve and inner tube means inside said outer sleeve and generally coaxial therewith, said method comprising providing a container defining a volume for containing a load of said material and having an opening in the top thereof in communication with said volume, a lower closure device secured to the container at the top thereof movable between a closed position closing said opening and an open position for permitting access to said volume via said container opening, and an upper closure device on the container above the lower closure device, at least part of said upper closure device being adapted for removal from the container to permit access to the container opening when said lower closure device is in its open position, releasably connecting the container to the tubular head with the outer sleeve in sealing engagement with respect to the container when at least part of the upper closure device is removed from the container and when said lower closure device is in its closed position, moving said lower closure device from its closed position to its open position, moving said inner tube means of the tubular head relative to the outer sleeve from a raised position to a lowered position in which the inner tube means extends down through said opening in the top of the container, and moving said lower closure device from its open position into sealing engagement with said inner tube means prior to transfer of material to or from the container.

21. A method as set forth in claim 20 further comprising moving said inner tube means back to its raised position after said transfer is substantially complete, moving said lower closure device to its closed position thereby to close the container opening, and thereafter disconnecting the container from the tubular head.

22. A method as set forth in claim 21 further comprising removing at least part of said upper closure device from the container prior to securing the container to the tubular head, and reattaching said at least part of said upper closure device to the container after the container has been disconnected from the tubular head.

23. A method as set forth in claim 21 wherein said inner tube means comprises a fill tube through which material flows into the container to fill it, and a vent tube surrounding the fill tube and coaxial therewith, said vent tube being spaced from the fill tube to define an annular gap therebetween, said fill and vent tubes being movable conjointly between said raised and lowered positions, said method further comprising moving said lower closure device from its open position into sealing engagement with said vent tube prior to transfer of material to the container, and thereafter drawing a vacuum through said annular gap to remove dust and dust-laden gas from the container during transfer of material to the container.

24. A method as set forth in claim 23 further comprising continuing to draw a vacuum through said annular gap after filling of the container is substantially complete and after said fill and vent tubes have been raised but before closing said lower closure device.

25. A method as set forth in claim 24 further comprising vibrating said tubular head as said vacuum is drawn.

26. A method as set forth in claim 21 wherein said inner tube means comprises a single vent tube through which gas is vented during unloading of the container, said method further comprising moving said lower closure device from its open position into sealing engagement with said vent tube prior to transfer of material from the container, and thereafter drawing a vacuum through the vent tube to vent air from the container during transfer of material from the container.

27. A method as set forth in claim 26 further comprising continuing to draw a vacuum through the vent tube after unloading of the container is substantially complete and after the vent tube has been raised but before closing said lower closure device.

* * * * *